United States Patent [19]

Shigyo et al.

[11] 4,020,597

[45] May 3, 1977

[54] MOBILE SURFACE CLEANING AND POLISHING APPARATUS

[75] Inventors: Genshichi Shigyo; Takuji Nishio, both of Tokyo, Japan

[73] Assignee: Magstar Engineering Co., Ltd., Japan

[22] Filed: Apr. 22, 1975

[21] Appl. No.: 571,001

[30] Foreign Application Priority Data

Oct. 25, 1974 Japan ..... 49-123055

[52] U.S. Cl. ..... 51/9 M

[51] Int. Cl.[2] ..... B24C 3/06

[58] Field of Search ..... 51/8 R, 8 BR, 9 M, 174; 15/340; 209/219; 299/17, 39

[56] References Cited

UNITED STATES PATENTS

| | | | |
|---|---|---|---|
| 2,684,558 | 7/1954 | Harris et al. | 51/8 BR |
| 3,380,196 | 4/1968 | Mabille | 51/9 M |
| 3,691,689 | 9/1972 | Goff | 51/9 M |
| 3,766,586 | 10/1973 | Krickouich | 15/340 X |
| 3,858,359 | 1/1975 | Leliaert | 51/9 M |
| 3,872,625 | 3/1975 | Fuma et al. | 51/9 M |
| 3,877,175 | 4/1975 | Snyder | 51/9 M |
| 3,934,373 | 1/1976 | Leliaert et al. | 51/9 M |

*Primary Examiner*—Al Lawrence Smith
*Assistant Examiner*—Nicholas P. Godici
*Attorney, Agent, or Firm*—Robert E. Burns; Emmanuel J. Lobato; Bruce L. Adams

[57] ABSTRACT

A mobile floor cleaning and polishing apparatus is readily movable along the floor or horizontal surface to be treated to effect cleaning and polishing of a large metallic surface such as a ship deck. The apparatus comprises a mobile frame assembly having a centrifugal projector mounted thereon for impelling abrasive particles against the surface, a magnet drum for attracting and collecting the used abrasive particles accumulated on the surface, and a vacuum suction system for recovering heavy or large particles not recovered by means of the magnet drum. The vacuum suction system collects not only the heavy abrasive particles but also the removed paint, scale and other waste matter thereby preventing any contaminants from being introduced into the atmosphere.

2 Claims, 8 Drawing Figures

MOBILE SURFACE CLEANING AND POLISHING APPARATUS

FIELD OF THE INVENTION

The present invention relates to a cleaning and polishing apparatus and more particularly to a mobile surface abrading apparatus for projecting polishing and cleaning material such as shot or grit to grind, polish and clean a horizontal surface such as a hull or a floor or deck.

PRIOR ART AND SUMMARY OF THE INVENTION

There are many industries which employ large steel or other material surfaces such as ship building or tank building industries. The surfaces of decks and hulls of a ship or walls of a tank must be periodically painted and subjected to other treatment to maintain them in good working condition and/or clean and polish them in order to remove scale, rust, old coat of paint and other foreign matter.

Recently, such necessity has increased as descaling and scraping rust or old paint deposited on decks and hulls of ships, cleaning cover plates used in a construction work, scraping and erasing the painting marks of a pedestrian crossing and the center line on a road and applying slip preventing treatment to an airplane runway or express way efficiently and economically.

Usually, these surfaces have been manually cleaned and polished by wire-brushing, hand-scraping or means of a disc sander. These prior art cleaning techniques are normally performed by crews of workmen and accordingly are accompanied many disadvantages such as taking much time and the workmen are subjected to a dangerous condition.

Although a sandblasting technique has been widely employed in order to accomplish foundation treatment on the upper deck of ships or outer walls of oil tanks before painting them, it is also accompanied by many drawbacks. In the conventional sandblasting technique, the dust generated by carrying out the technique is so voluminous that working efficiency is badly deteriorated and often the dust and other contaminant pollute the surrounding atmosphere.

For example, a surface cleaning device disclosed in U.S. Pat. No. 3,691,689 has a rotating brush only as a mechanism for recovering abrasive particles, so that recovery efficiency of dust, waste materials and foreign matters or the like is made extremely low.

In practice, when the thickness in the accumulated materials to be collected reaches above 3 mm, even a collecting mechanism of the prior art adapted to collect shot left on the surface to be treated and the matter scraped therefrom by a use of a magnet drum and the horizontal brush could not accomplish completely the collecting function.

Therefore, it has been desired that the sandblasting technique or method be replaced by a new effective one.

The present invention relates to a mobile cleaning and polishing device and more particularly to a mobile floor cleaning and polishing apparatus which carries out sandblasting or abrasively cleaning operation to floors such as horizontal steel plate surfaces including upper decks of ships and other large surfaces. More particularly, the mobile floor cleaning and polishing apparatus according to the present invention comprises a projector for impelling abrasive particles against a surface to be cleaned and a collection system for collecting the abrasive particles thereby preventing any contaminants from being introduced into the atmosphere.

According to a first feature of the present invention, the above-mentioned centrifugal projector is adapted to be mounted on a rotatable turn-table. The abrasive materials or particles are projected by the centrifugal projector and all the abrasive particles impelled against a surface to be cleaned and polished and are recovered so as to be reused. A projection port of the centrifugal projector is rotated by a desired angle with respect to an advancing direction of a car on which the apparatus is mounted, by means of the turn-table in order to change the width of a surface subjected to an abrasive cleaning operation.

Nowadays, as a result of various recent experiments or studies, some problems to be solved have been apparent. One of the problems is how to apply an optimum, efficient and economical cleaning and polishing treatment to a surface to be polished and cleaned, which is one of the main study themes of the present invention.

That is to say, the width to be cleaned and polished when the prior art centrifugal projector is employed is restricted to the width of a projection opening formed to a fixed size. Therefore, when a white line painted on the road is to be erased, the width of the projection port or opening is preferably designed to have at least one and a half times as wide as that of the white line, which width is that of the white line added by the sufficient width enough to compensate for an operating error. In this way, once the cleaning and polishing apparatus passes on the white line, it can be completely erased. However, in this case, it is desirable not to erase unnecessary portions placed at the both sides of the white line.

In other cases however, the floor to be treated, cleaned and polished is very large such as a deck of a ship, and the run way, the width to be cleaned and polished by one passing of the cleaning and polishing apparatus is made as wide as possible.

Even though the car has good mobility, it can not supplement the aforementioned disadvantages of unchangeability of the width of a floor to be cleaned and polished. It will be advantageous that a particular and suitable apparatus is prepared for respective use. However the preparation of the particular apparatus for respective use is almost impossible at present because of economic reason.

According to a feature of the present invention, the car has characteristic of running along its advancing direction, the width to be cleaned and polished is not determined nor restricted by the size of a width of a projection port. When the difference in dimensions between the width and the length of the projection port is very large, the centrifugal projector disposed on a turn-table exhibits its useful function.

Namely, the present invention is directed to carrying out of an optimum abrasive cleaning by rotating the projection port of the centrifugal projector by a necessary angular movement to slant the port with respect to the advancing direction of the car in order to change the width of the surface to be treated, which width is determined according to various kinds or conditions of the objects of the abrasive cleaning.

In accordance with a second feature of the present invention, the collection system for collecting the abrasive particles and the removed materials consists of a magnetic drum and a vacuum suction means.

According to the preferred embodiment of the present invention, there is provided a mobile floor cleaning and polishing apparatus having a centrifugal projector for impelling abrasive cleaning particles such as solid and fine shot or grit, a magnet means for attracting and collecting a primary portion of the abrasive particles accumulated on the floor to be treated, and a vacumm suction means for collecting, if any, the remaining abrasive particles not attracted to the magnet means and the materials removed from the surface to be treated. The magnet means is situated at the front of the vacuum means.

More particularly, there is provided a mobile floor cleaning and polishing apparatus having a centrifugal projection the projection port of which is rotated by a desired angle with respect to a direction that a car advances by rotating a turn-table on which the centrifugal projector is mounted in order to change the width of a surface of the structure subjected to an abrasive cleaning operation, whereby an optimum or effective cleaning and polishing may be constantly achieved. The preferred embodiment of the present invention further comprises a rotating magnet drum mounted under the chassis of the automobile for removing the abrasive particles accumulated on the surface to be treated as much as possible and a vacuum suction means also mounted under the chassis for collecting or recovering the remaining particles not collected by means of the magnet drum. Having in mind the above and other objects that will be evident from the understanding of the disclosure, the present invention comprises the combination and arrangements of parts illustrated in the preferred embodiment of the invention which is hereinafter set forth in sufficient detail to enable those persons skilled in the art to clearly understand its function, operation, construction and advantages.

As apparently shown above, the floor cleaning and polishing apparatus of the present invention was especially designed to overcome the aforementioned disadvantages and to effect cleaning of the desired surface in a rapid and efficient manner without discharging any dust particles into the surrounding atomoshpere.

OBJECTS OF THE INVENTION

A primary object of the present invention is to provide a cleaning and polishing apparatus which abrasively cleans large surfaces of structures and perfectly collects the abrasive particles along with the removed scale, paint chips and other foreign matter thereby preventing dust and other contaminants from polluting the surrounding atomosphere.

Another object of the present invention is to provide a mobile surface cleaning and polishing apparatus which is easily movable from work site to work site.

A further object of the present invention is to provide a mobile floor cleaning and polishing apparatus which is continuously operative to abrasively clean a surface and collect or recover the used abrasive particles along with the removed waste material and separate the reusable abrasive particles and continuously recycle them for further use.

Yet another object of the present invention is to provide a cleaning and polishing apparatus which is movable along the surface to be treated and provided with a centrifugal projector of shots or grit.

Still another object of the present invention is to provide a cleaning and polishing apparatus which includes a rust removing device for exfoliating rust and old paint coats or a centrifugal projector for projecting abrasive particles such as shots against the surface to be treated deposited on the surface.

Still another object of the present invention is to provide a mobile cleaning and polishing apparatus having a size-changeable port of a centrifugal projector in order to effectively apply the device to the various width of the floor portion to be treated.

Still another object of the present invention is to provide a mobile floor cleaning and polishing apparatus having a centrifugal projector mounted on a mobile device and in order to make the used shot reuseable and prevent the occurrence of the dust, an air suction type shot recovery device is provided, so that the shot blasting work can be automatically carried out.

Also, still another object of the present invention is to efficiently take advantage of the recovery action of the shot which is projected and impelled against the surface to be abrasively cleaned and polished at high speed. Specifically, in the travelling speed of the mobile device is so low, shot tend to remain on the surface subjected to the surface treatment. The remaining shot, according to the present invention, are completely recovered by the magnet drum located in the rear of the centrifugal projector in order to attract and collect the abrasive particles accumulated on the surface.

Another object of the present invention is to provide a mobile floor cleaning and polishing apparatus travelling on a horizontal surface of a floor such as a steel plate which includes a main frame, a rotatable magnet drum which can move vertically relative to the surface by a suitable means in order to recover a primary portion of the abrasive particles accumulated on the surface. A projector is on the main frame for impelling shot at a high speed and a guide casing for guiding the shot, which guide casing is adapted to confront the surface to be abrasively cleaned.

An object of the present invention is to provide a mobile cleaning and polishing apparatus travelling on a horizontal surface of a steel plate which includes a flat and long vacuum suction nozzle for absorbing the removed materials. The nozzle is connected to a collector or hopper through a flexible duct.

Yet another object of the present invention is to provide a mobile floor cleaning and polishing apparatus travelling on a horizontal portion of a surface which includes a supply duct of the collector connected to an inlet of the projector and a suction duct of a scavenging pump which effect recovering the shot and the removed materials. The suction duct is connected to said collector, which mobile apparatus is mounted on an automobile having a frame.

Yet another object of the present invention is to provide a mobile floor cleaning and polishing apparatus travelling on a horizontal surface, which includes a shot projector for blasting shots against the surface, a rotatable magnet drum adapted to extend along the surface in order to collect the shots accumulated on the floor, and a vacuum suction system for absorbing the materials removed from the surface.

The above and other objects of the present invention are achieved out by a mobile floor cleaning and polishing apparatus comprising a mobile body, a centrifugal projector for impelling solid and fine abrasive particles such as shots or grit contained in the mobile car. The abrasive particles impelled on the surface to be polished and cleaned are all recovered, and returned to the centrifugal projector so as to be reused. The materials removed from the surface also are all collected so as to prevent the atmosphere from being polluted.

DETAILED EXPLANATION OF THE PREFERRED EMBODIMENT

Figure 1:
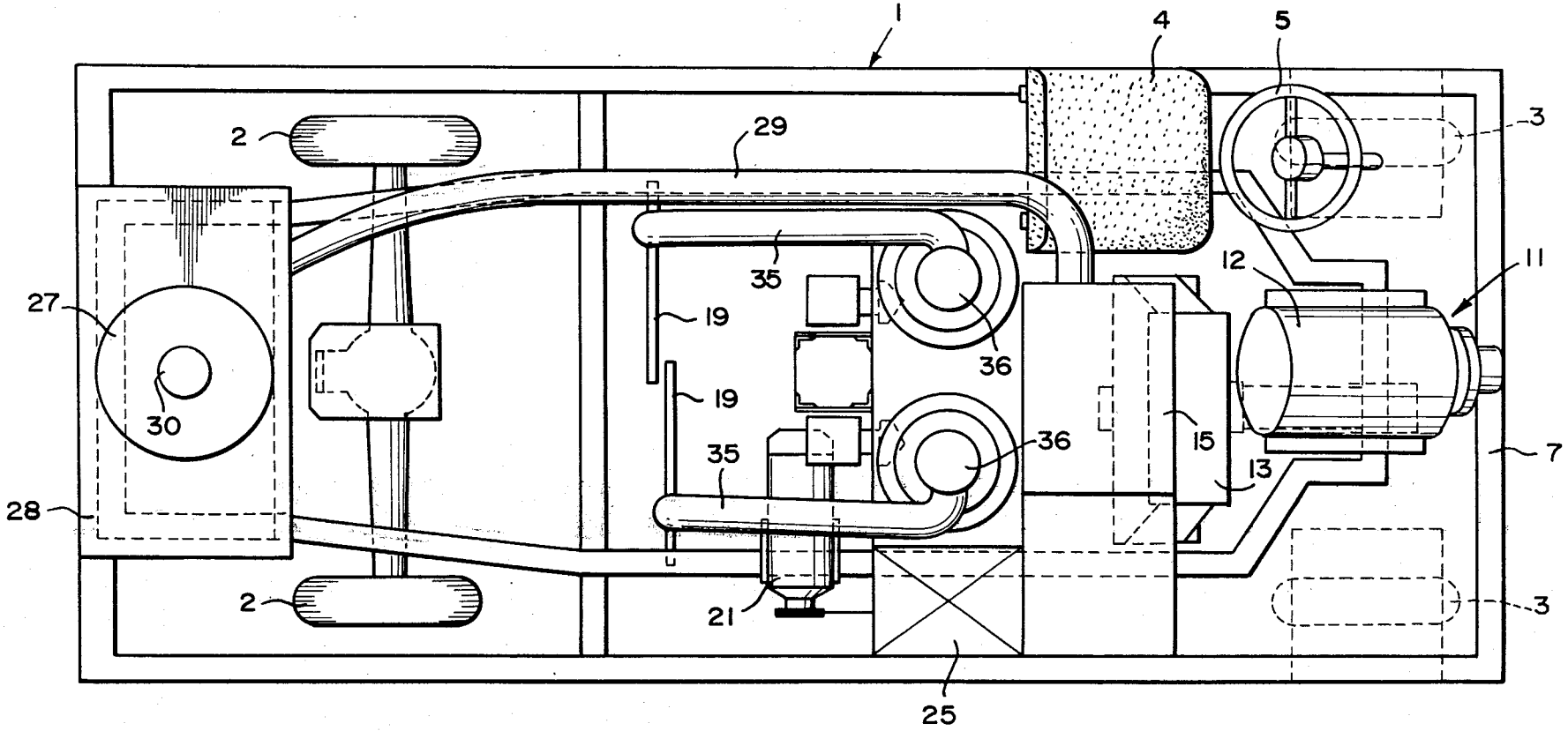
FIG. 1 through FIG. 3 are respectively plan, side and front views showing an embodiment of a floor cleaning and polishing apparatus made in accordance with the present invention.

In the preferred embodiment of the present invention, a motor tricycle 1 is as a transportation means used as apparently shown in FIG. 1.

Two front wheels 3 are engine-driven as drive wheels of the transportation means and one rear wheel 2 is a steering wheel which an operator sitting on an operator's seat 4 can steer by the use of a steering handle 5.

An engine of a car 1 is contained in an engine room situated under the seat 4. In more detail, a hydraulic pump is driven by an engine such as an air-cooled four-cycle gasoline engine and the car is hydraulic-driven.

The running speed and abrasive cleaning speed of the car is about 1 to 6 m/min. A generator is also driven together with the car by the engine.

On a chassis 7 of the car, are provided various machines or devices required for the cleaning and polishing operation. A turn-table 10 is rotatably disposed at a position near to a front portion of the car through a vertical roller 8 inscribing a periphery of a circular hole formed on a chassis 7 and a horizontal roller 9 mounted on an upper surface. Mounted on this turn-table 10 is the chassis 7 of a centrifugal projector 11. The centrifugal projector 11 described herein is constructed in such a manner that an impeller 14 in a casing 13 is rotated at a high speed by means of an electric motor and abrasive particles such as shot or grit supplied through a duct from a hopper 15 are projected at a high speed through a projection port of a cover casing 17 brought to a truly close position to a surface to be cleaned and polished and extending from the turn-table downwards.

A grounding rubber seal 16 is provided on an end edge of a grit guide 17 to use effectively the air suction of a scavenging pump.

A rotating magnet drum 24 is disposed horizontally at right angles with the direction which the car progresses in a rear position of the projection port or the centrifugal projector 11 and is adapted to be rotatably driven in the same direction as the car's advancing direction by a motor 21 mounted on the chassis 7.

Figure 2:
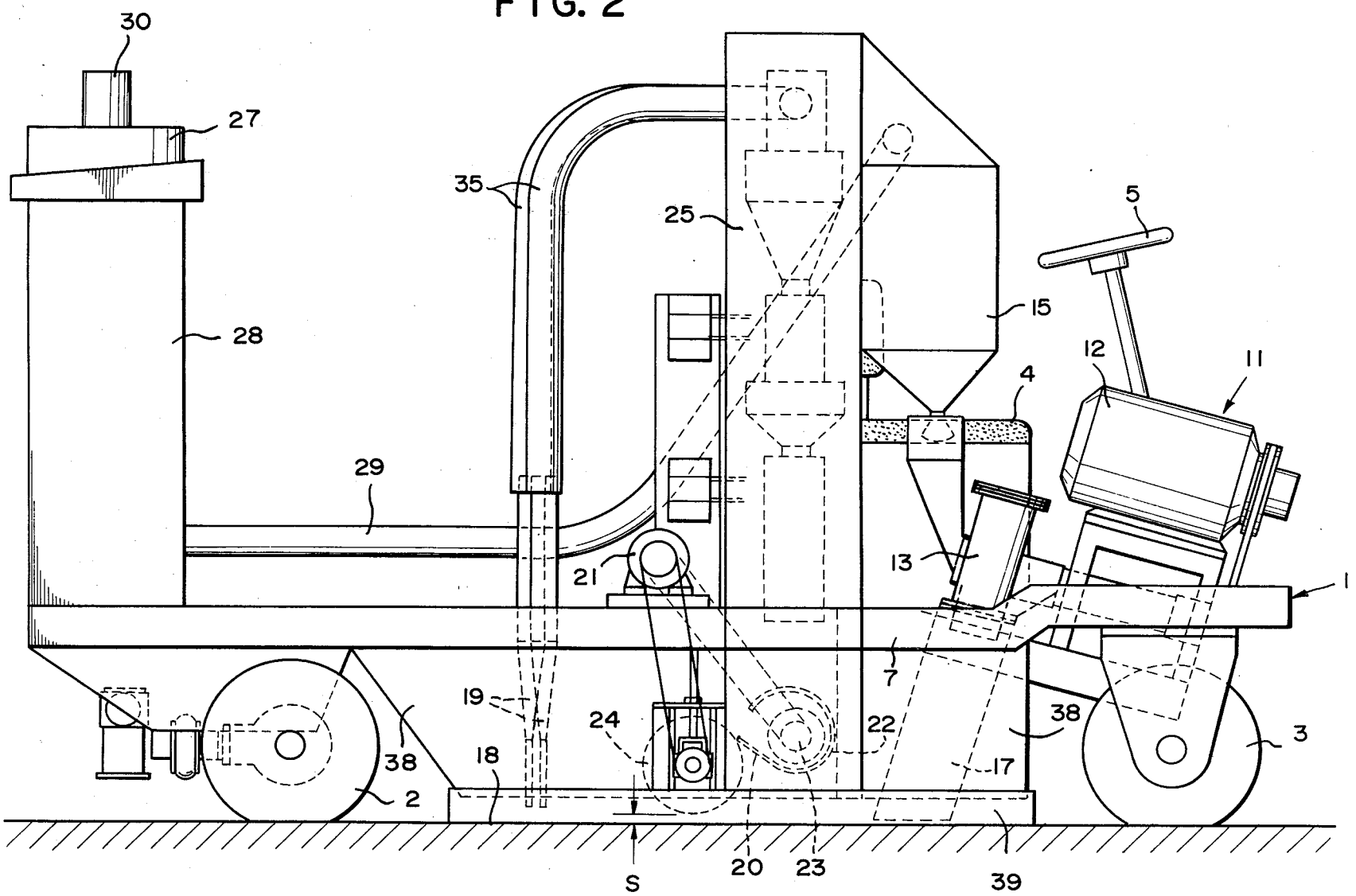
Figure 3:
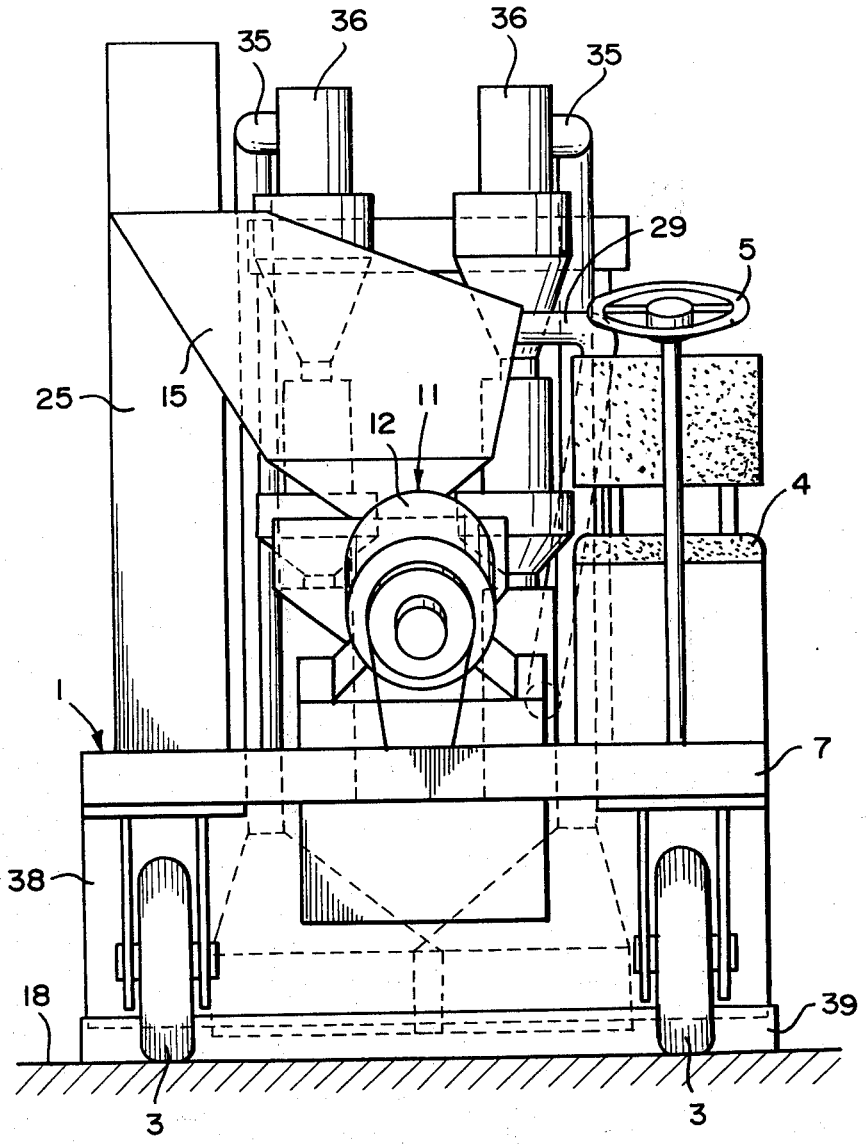

This rotating drum 24 functions to recover the abrasive cleaning materials blasted by the projector. A scraper 20 is disposed in a front portion tangentially of the rotating drum 24. As shown in FIG. 2, the scraper 20 is curved in its cross sectional view and extends over and along a screw conveyor 23 entering a conveyor housing 22 which drum will be explained more clearly. The screw conveyor 23 cross-feeds the abrasive cleaning particles.

A bucket conveyor 25 for vertically carrying the abrasive surface cleaning particles is secured on a termination of the screw conveyor 23. An outlet of the bucket conveyor is connected to the rear position of the hopper 15. A bag filter 28 is situated on a rear portion of the car. The bag filter takes advantage of a negative pressure at a suction side of a blower 27. A dust hose 29 of the bag filter 28 is connected to a separating room of a selecting portion constructed on the way from the bucket conveyor 25 to the hopper 15 and these members constitute a dust collecting system.

A selecting metal net for separating coarse rubbish is employed in the hopper 15 for receiving the selected coarse rubbish dropping from the metal net, a downward duct for the hopper and a chute for the downward duct are also used in the embodiment of the present invention. 30 designates an electric motor for the blower 27.

The turn-table may be operated by the use of a manual or an electric means. In each case the means, a rotating mechanism itself, must have an easily controllable securing mechanism for positioning or otherwise such mechanism has to be used independently of the rotating mechanism.

Figure 4:
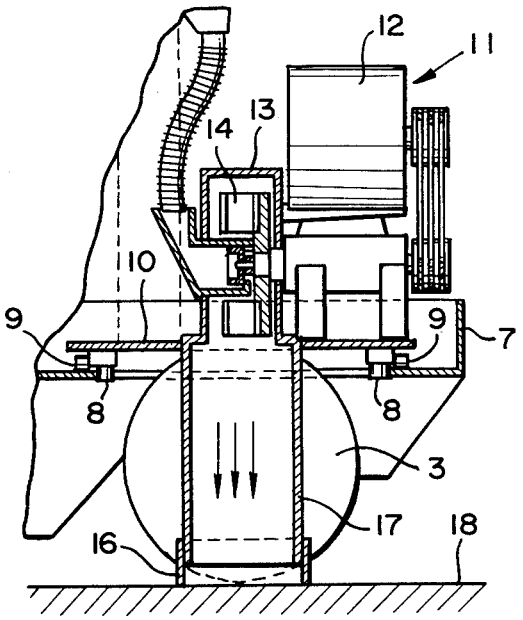
FIGS. 4 and 5 are respectively a side view and a top view of an embodiment of the turn-table and a shot projector.
Figure 5:
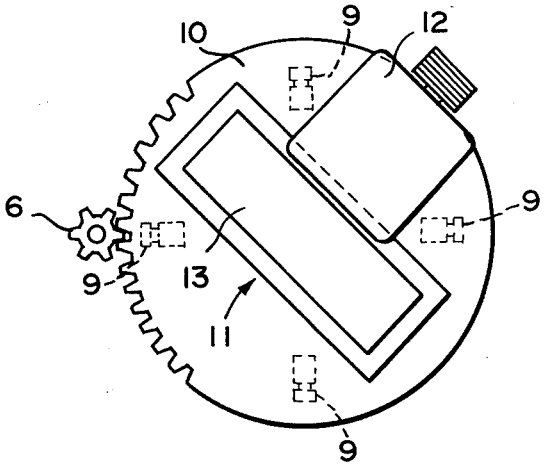

For example, as shown in FIGS. 4 and 5, one of the securing mechanism for positioning the projection port is constructed in such a manner that teeth are formed around as part of the periphery of at least 90° of the turn-table 10 and pinion 6 engaging with these teeth are actuated by a hydraulic motor or an electric motor 12 provided with a brake.

Generally, the centrifugal projector 11 possesses the faculty for projecting 80 kg of the abrasive cleaning particles for one minute the diameters of which are 1 to 2 mm, at a speed of about 60 cm/sec. The projection port of the centrifugal projector may be sized to 15 × 45 cm.

In accordance with the preferred embodiment of the present invention, when a white dividing line on a road is erased, the turn-table is rotated and set in a position in which the smallest width is subjected to a surface cleaning operation. When a larger area is desired to be abrasively cleaned and polished, the turn-table is rotated and set in another position in which the largest width is cleaned and polished. Therefore, the mobile floor cleaning and polishing device of the present invention can achieve the abrasive cleaning operation effectively.

Under the chassis 7 of the mobile apparatus, there is disposed a cylindrical magnet drum 24 having a strong attractive force. The magnet drum 24 is adapted to be rotatably driven in the same direction as the rotating direction of the running wheels of the mobile floor cleaning and polishing apparatus when it moves forward and in the opposite direction of the running wheels when it moves backward. The cylindrical magnet drum is positioned in its horizontal position and right angled to the longitudinal axes of the mobile apparatus.

A gap having a height $s$ is formed between a lower end of the magnet drum 24 and the surface 18 to be treated, so that a part of the magnetic abrasive particles accumulated on the surface is attracted by the magnet drum and collected on the cylindrical surface of the magnet drum. The gap height *s* is determined according to the depth of the abrasive particles accumulated on the surface or the depth of accumulated abrasive particles to be attracted by the magnet drum. In short, the magnet drum is movably mounted on a chassis of the mobile floor cleaning and polishing apparatus so as to move vertically and to make an approach to the surface to be treated and away from it. Therefore, the gap height *s* is freely or suitably controlled to determine the depth of abrasive particles remaining on the floor or surface to be treated. Practically, when the gap height *s* is suitably selected, the primary portion of the magnetic abrasive particles accumulated on the floor can be attracted and removed by the magnet drum.

As shown in FIG. 2, a curved plate constructs a recovery port 22 in which the screw conveyor 23 is situated. The scraper on a lower plate 20 extends under the recovery port 22 and an edge of the scraper member contacts a cylindrical surface of the magnet drum so as to scrape off the magnetic abrasive particles attracted and collected on the cylindrical surface. The edge of the scraper member contacts the cylindrical surface of the magnet drum and almost makes a tangent to a periphery of the cylindrical magnet drum in order to effectively scrape off the magnet abrasive particles collected on the cylindrical surface of the drum. The screw conveyor 23 and the magnet drum 24 are adapted to be rotatably driven by the electric motor 21 mounted on the chassis 7.

The contacting angle of the edge of the scraper member to the cylindrical surface of the magnet drum can be regulated so as to improve a scraping effect of the scraper member. The extending direction of the scraper member is determined so as to make a downward flow of the abrasive particles scraped off the magnet drum along the lower plate or the scraper member 20 into the screw conveyor 23.

Practically, according to the present invention, the magnetic abrasive particles made of magnetic material are shot by the shot blast means 11 against the surface to be treated and accumulated on the surface. Then the magnetic abrasive particles or shot accumulated on the surface are attracted and collected on the cylindrical surface of the magnet drum 24 situated in the rear position of the shot blast means 11. Due to the rotational movement of the magnet drum 24, the abrasive particles collected on the cylindrical surface of the magnet drum are scraped off the cylindrical surface by the scraper member 20 and thrown into the screw conveyor 23. When the gap height *s* under the cylindrical surface of the magnet drum is very small, only the heavy or large particles not carried along with the cylindrical surface of the rotating magnet drum are retained. The retaining large particles and the materials removed from the surface 18 are collected by means of the vacuum suction system along the curved ducts 35 and finally entered into a vacuum suction apparatus 36.

Figure 6:
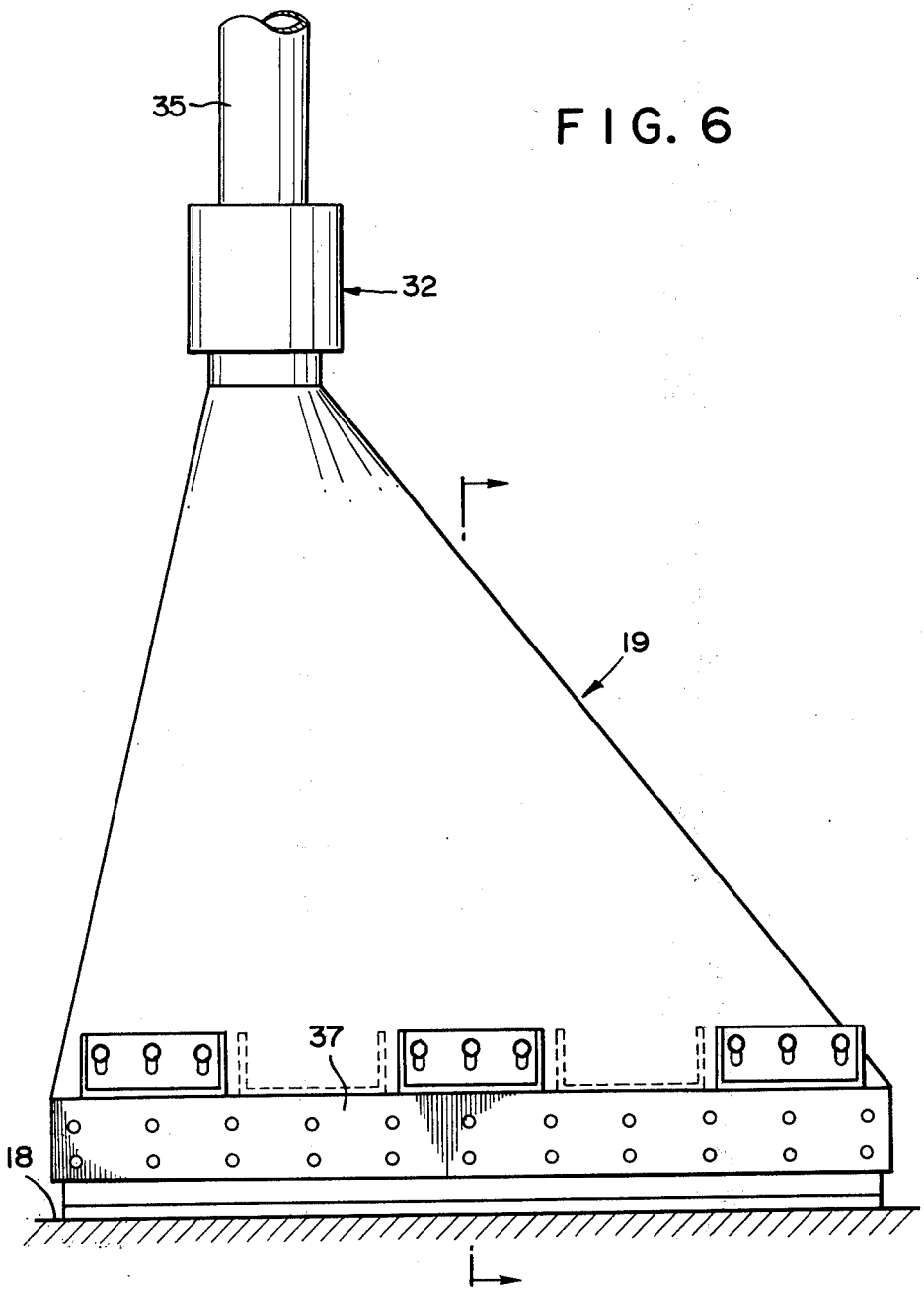
FIG. 6 is a front view of a suction nozzle of the vacuum suction system.
Figure 7:
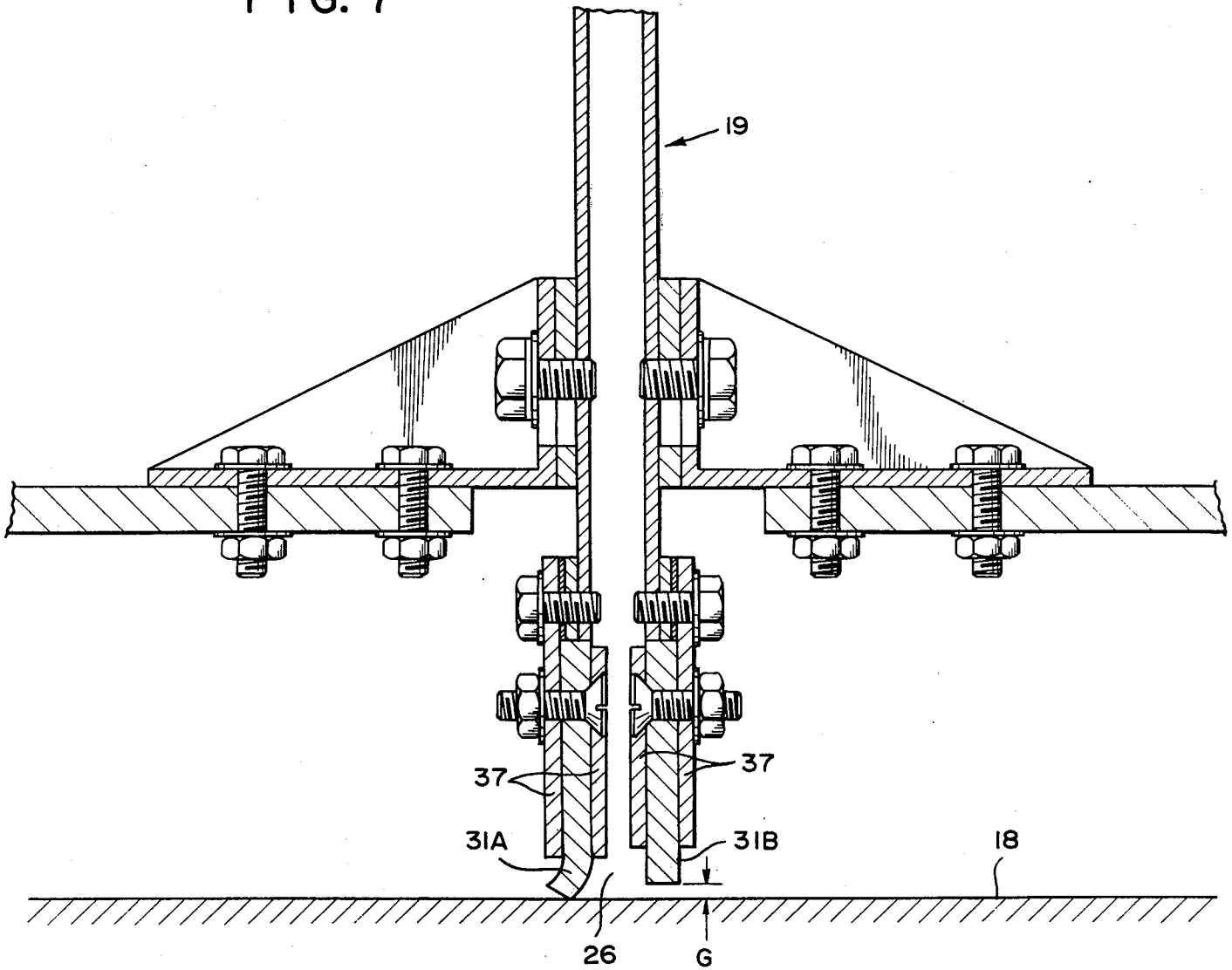
FIG. 7 is a sectional view taken along VII—VII of FIG. 6.
Figure 8:
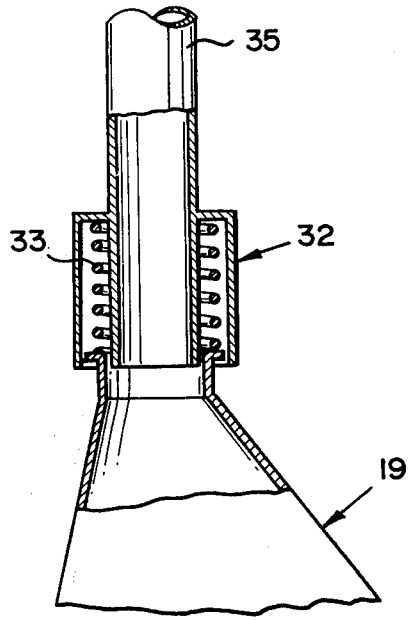
FIG. 8 is a partly sectional view showing a spring mechanism of the suction nozzle of the present invention.

The vacuum suction system will be described in more detail in connection with FIGS. 6, 7 and 8 in the drawings. The vacuum suction system for collecting the remaining shot or particles along with the removed materials such as rust, dust and other foreign matter consists of a pair of flat and long nozzles 19 arranged partly overlapped to each other, a pair of vacuum suction apparatus 36 and a pair of ducts 35 connecting the nozzles to the vacuum suction apparatus. As shown in FIG. 7, the flat and long nozzles 19 connected to the vacuum apparatus 36, for example a marketed industrial vacuum cleaner by means of the ducts 35 respectively have a pair of depending members 31A, 31B made of elastic material such as rubber. A depending member of them numbered with 31B has a shorter length than other member 31A by a distance greater than a gap G. The longer elastic member 31A has a long inside edge, which edge is pressed against the floor 18 to be treated and slides along the floor. While the mobile surface cleaning and polishing apparatus manufactured in accordance with the present invention is operated and moved along the floor to be treated, the shot projected through the centrifugal projector and accumulated on the floor are collected by the rotatable magnet drum 24. When a primary portion of the shot or particles accumulated on the floor are not carried along with the cylindrical surface of the rotating magnet drum and partly remain on the floor after a passing of the drum, the vacuum suction nozzles 19 absorb the remaining shot and the removed materials such as rust and old coat of paint.

When the suction nozzles 19 advances along the floor 18 so as to collect the remaining particles and remove materials, the longer elastic member 31A is bent rearwardly so as to catch each of the particles and lead them into the suction nozzles 19. As described above, the vacuum suction nozzle respectively are arranged so as to overlap each inner end portion of the nozzles in order to effectively catch all the particles and the removed materials entered into the entrance of the nozzles 26 through a long horizontal gap G.

According to the present invention, the elastic depending members 31A, 31B are reinforced by reinforcing plates 37 attached to both sides of the elastic depending members so as to reinforce or strengthen the elastic depending members and to improve the absorbing efficiency of the vacuum suction system 11.

According to the present invention, the suction nozzles 19 respectively have damping devices 32. The devices 32 each has, as shown inFIG. 8, a cylindrical portion 32 formed at an end of the duct 35 and a coil spring 33 installed in the cylinder. When the cleaning and polishing apparatus of the present invention advances on an irregular surface or rough floor, the vacuum suction nozzles move vertically so as to correspond to the evenness of the floor to be treated by means of the damping devices 32 installed at the tops of the nozzles. Accordingly, the suction nozzles are not struck with an irregular portion and prevented from being damaged. As shown in FIG. 2, a depending housing 38 mounted on the chassis 7 houses the projecting opening 17, the magnetic drum 24, the screw conveyor 23 and a vacuum suction nozzles 19. The depending housing 38 has a skirt portion 38 mounted on the depending end of the housing 38 so that any dust or particles not collected by the magnetic drum and not absorbed by the vacuum suction system don't escape from the interior of the housing and don't pollute the air surrounding the apparatus.

The steering handle 5 permits the mobile cleaning and polishing apparatus to move frontwards and backwards, and leftwards and rightwards to accomplish an efficient abrasive cleaning work. Specifically, in case travelling speed of a mobile bogie is low, the shot projected against the surface to be worked is apt to remain thereon. Consequently the remaining shot is adapted to be recovered along with the removed materials such as scale, rust or old paint by controlling the absorbing effect of the suction nozzle, which nozzle is provided in the rear of the centrifugal projector 11 and the rotatable magnet drum 24 so as to closely face the floor to be treated.

The invention has been described in conjunction with a particular embodiment and it is to be understood that obvious modifications and changes may be made without departing from the spirit and scope of the present invention as defined in the appended claims.

We claim:

1. A mobile surface cleaning and polishing apparatus comprising, a mechanism for driving and propelling the cleaning and polishing apparatus, a centrifugal projector mounted on the apparatus and having an elongated port for projecting therethrough shot or grit downwardly against a surface to be treated, and recovery means for recovering the shot or grit projected and remaining on the surface and all surface material removed from the surface, said recovery means consisting of a rotary driven magnetic drum for attracting magnetic materials and a vacuum suction system having suction means situated rearwardly of the rotary magnet drum and means for collecting any materials not attracted by the magnetic drum and remaining on the surface after treatment with said shot, said remaining materials comprising shot or grit and material removed from said surface by treatment thereof, a hopper, a turn-table rotatably mounting said centrifugal projector to selectively turn horizontally said projector for varying the effective length of said port thereby to vary the width of the surface treated, a scavenging pump, a bag filter, an air duct system having ducts connecting said pump and said filter, a bucket conveyor transmitting used grit or shot and foreign matter to said hopper, and conduit means for connecting said centrifugal projector to said hopper.

2. A mobile surface cleaning and polishing apparatus comprising, a mechanism for driving and propelling the cleaning and polishing apparatus, a centrifugal projector mounted on the apparatus and having an elongated port for projecting therethrough shot or grit downwardly against a surface to be treated, and recovery means for recovering the shot or grit projected and remaining on the surface and all surface material removed from the surface, said recovery means consisting of a rotary driven magnetic drum for attracting magnetic materials and a vacuum suction system having suction means situated rearwardly of the rotary magnet drum and means for collecting any materials not attracted by the magnetic drum and remaining on the surface after treatment with said shot, said remaining materials comprising shot or grit and material removed from said surface by treatment thereof, said vacuum suction system suction means comprising two long, nozzles having a flat, elongated cross section respectively arranged parallel to each other and to extend horizontally along the surface being treated, said nozzles being disposed defining a predetermined gap between the surface being treated and lower edges of the nozzles, said vacuum suction system including a pair of ducts connecting the nozzles independently to said scavenging pump and two damping devices each situated between a corresponding nozzle and one of the ducts of said pair of ducts, said damping devices each comprising a cylindrical housing and a coil spring contained therein for allowing upward and downward movement of the nozzles individually for compensating for unevenness of said surface being treated, and said nozzles each having a set of elastic depending members one of said members contacting with the surface treated and the other being separated from the surface being treated.

* * * * *